United States Patent [19]

Kreeger

[11] Patent Number: 4,523,681

[45] Date of Patent: Jun. 18, 1985

[54] MULTILEVEL STACKING CONTAINER

[75] Inventor: Elsmer W. Kreeger, Howell, Mich.

[73] Assignee: Pinckney Molded Plastics, Inc., Pinckney, Mich.

[21] Appl. No.: 586,289

[22] Filed: Mar. 5, 1984

[51] Int. Cl.[3] ..... B65D 21/04

[52] U.S. Cl. ..... 206/507

[58] Field of Search ..... 206/507

[56] References Cited

U.S. PATENT DOCUMENTS

| | | | |
|---|---|---|---|
| 3,425,594 | 2/1969 | Bridenstine | 206/507 |
| 3,481,507 | 12/1969 | Sanders . | |
| 4,093,070 | 6/1978 | Stahl . | |
| 4,106,624 | 8/1978 | Thurman | 206/507 |
| 4,189,052 | 2/1980 | Carroll | 206/507 |
| 4,334,616 | 6/1982 | Wilson | 206/507 |

*Primary Examiner*—George E. Lowrance

*Attorney, Agent, or Firm*—Basile, Weintraub & Hanlon

[57] ABSTRACT

A multi-level stacking container is constructed in a manner such that two like containers may be stacked one upon the other in either of a high-level or low-level stacked relationship wherein the end walls of the upper container are respectively stacked upon upper or lower portions of the underlying container or in an intermediate stacked position wherein the side walls of the upper container are parallel to the end walls of the lower container, that is stacked crosswise to each other. This provides the possibility of stacking the container of the present invention with prior art containers of different configuration which utilize the cross-stacking arrangement.

2 Claims, 15 Drawing Figures

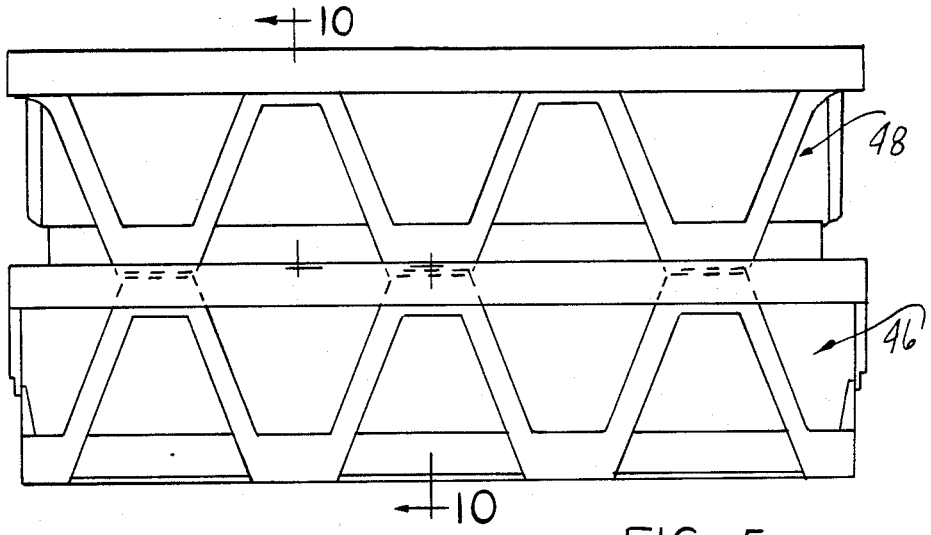
FIG-5
FIG-6
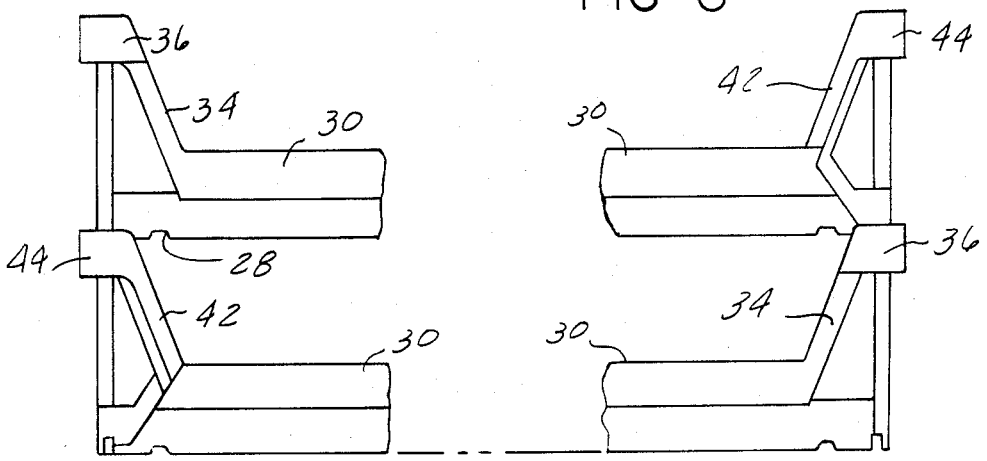
FIG-9
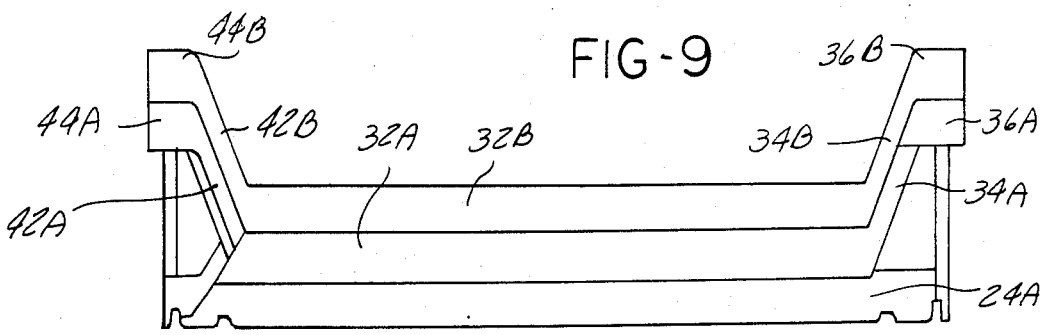

PRIOR ART

PRIOR ART

MULTILEVEL STACKING CONTAINER

BACKGROUND OF THE INVENTION

The present invention is concerned with multi-level stacking containers of the type typically employed for transporting and delivering bakery products. Containers of this type are conventionally designed to be stacked on upon the other in a stable stack in either of a high-level stacking relationship to avoid crushing of bakery products in the underlying containers or in a low-level stacking arrangement in which empty containers are nested to a greater or lesser degree within each other to minimize stack height when the empty containers are being returned to or stored at the bakery.

Two primary approaches to designs of containers which possess this high-level, low-level stacking capability are respectively shown in U.S. Pat. No. 3,481,507 and U.S. Pat. No. 4,093,070.

The container of U.S. Pat. No. 3,481,507 is constructed with side and end walls of uniform height. The opposite end walls of this container have complementary configuration such that when two of the containers are stacked with a first end wall of one container nested within the corresponding first end wall of the underlying container, the upper container is supported in a low-level stacked position. When the orientation of the upper container is shifted 180° so that the first end wall of the upper container overlies the second or opposite end wall of the lower container, the side and end walls of the two containers rest upon each other in a high-level stacked relationship.

The container of U.S. Pat. No. 4,093,070 is constructed with end walls which are substantially higher than the side walls of the container. When two of these containers are stacked with the end walls of the upper container resting on the end walls of the lower container, the containers are in a high-stacked position. When the upper container is displaced 90° so that its end walls are parallel to the side walls of the lower container, the bottom of the upper container is stacked upon the lowered side walls of the underlying container to establish the low-level stacked relationship.

This last container possesses the advantage of being of a simplified construction, as compared to the container of U.S. Pat. No. 3,481,507 and can be stacked in the high-level stacked relationship without regard to orientation of the end walls which are of identical construction in the container of U.S. Pat. No. 4,093,070. The disadvantage of the container of U.S. Pat. No. 4,093,070 is that it cannot nest as deeply into the lower container when in the low-level stacked relationship as can containers of the type of U.S. Pat. No. 3,481,507.

Although the width, length and height of both of the foregoing types of containers are generally standardized for various applications, such as to hold one dozen loaves of bread, concurrent usage of the two types of containers described above is normally not feasible. Nesting or interlocking the unlike containers in any sort of a low-level stacking relationship usually is not possible.

The present invention is especially directed to a container of the generic type of U.S. Pat. No. 3,481,507 which can be stacked with containers of the type of U.S. Pat. No. 4,093,070 in both stable high and low-level stacked relationship.

SUMMARY OF THE INVENTION

A container embodying the present invention is formed with a rectangular bottom having lower side and end rails extending along each side and end of the bottom around its entire periphery and lying in vertical general planes. First and second end walls, each having a main web lying in a vertical general plane are formed integrally with or fixedly secured to the outer side of the respective lower end rails, and a web-like horizontal upper end rail extends the outer length of the end wall at the outer side of the main web. The upper and lower end rails are thus offset horizontally from each other by the thickness of the main web. The main web of each side rail is formed with a series of symmetrically and oppositely inclined bar sections, each bar section being coupled at its upper and lower end to respective adjacent bar sections in the form of a series of V-shaped units interconnected at their upper ends by a short horizontal section which is duplicated at the lower end or apex of each V. The series of V units of each end wall is offset by one-half a V unit from those of the opposite end wall, thus when two containers are stacked one upon the other with the first end wall of the upper container vertically aligned with the first end wall of the lower container, the V-shaped units of the upper container will nest within the V-shaped units of the underlying container to establish the lower level stacked position. When like containers are stacked with their end walls reversed 180° from the aforementioned relationship, the bottom or apexes of the V-shaped units of the end walls of the upper container will rest upon the short connecting sections between adjacent V units of the underlying container to establish the high-level stacked position.

The side walls of the container are of the dropped type and include a main web lying in a general vertical plane integrally formed with or fixedly secured to the outer side of the respective side rails. The main web of the side wall has a horizontal upper edge which is located well below the level of the upper rail of the end walls and terminates short of the respective ends of the side walls. Symmetrically oppositely upwardly inclined bar sections at each end of the main web of the side walls project upwardly from the main web toward the upper rails of the side walls and are joined to the end of the upper rails of the side walls by a relatively short horizontal upper side rail section. The inclined bar sections of the side walls will nest within each other when the containers are stacked at their lower rest position.

The container side walls are longer than the end walls and the space between the lower ends of the oppositely inclined bar sections of the side walls is substantially equal to the width of the container. Notches formed in the lower edge of the lower side rails of the container are spaced from each other by a distance equal to the width of the container, and these notches may be seated upon the upper edges of the main web of the side walls of an underlying container to stably stack the two containers in a crosswise position—i.e., end walls of one container parallel to side walls of the other.

This crosswise stacked position, which would represent an intermediate level stacked relationship between the two like containers, is not generally employed, however, if the lowered main web of the container side walls permit crosswise stacking of a suitably dimensioned unlike container of the type shown in U.S. Pat. No. 4,093,070. Similarly, the container of the present application may be stacked in crosswise relationship upon a container of the type shown in U.S. Pat. No. 4,093,070, thus enabling intermingling of these two types of containers in a stable stack.

Other objects and features will become apparent by reference to the following specification and to the drawings.

IN THE DRAWINGS

FIG. 5 is an end view of two of the containers of FIG. 1 stacked one upon the other in a high-level stacking relationship;

FIG. 6 is a side elevational view of the two containers stacked at the high-level stacked relationship;

FIG. 9 is a side elevational view of two of the containers stacked in the low-level stacking relationship;

Figure 12:
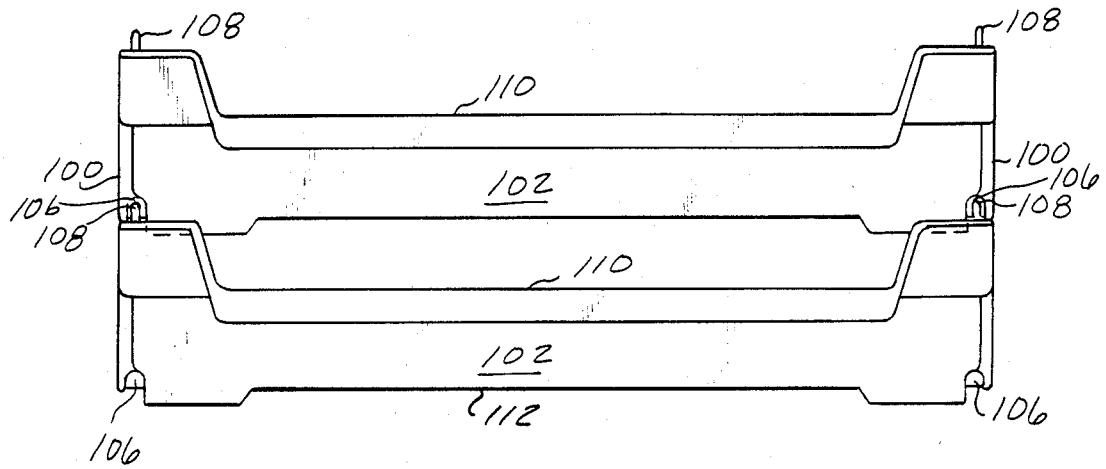
FIG-12 PRIOR ART
Figure 13:
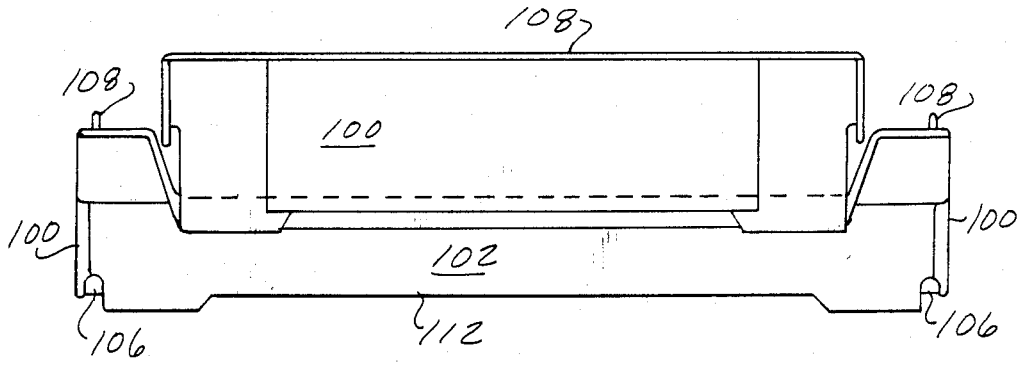
Figure 14:
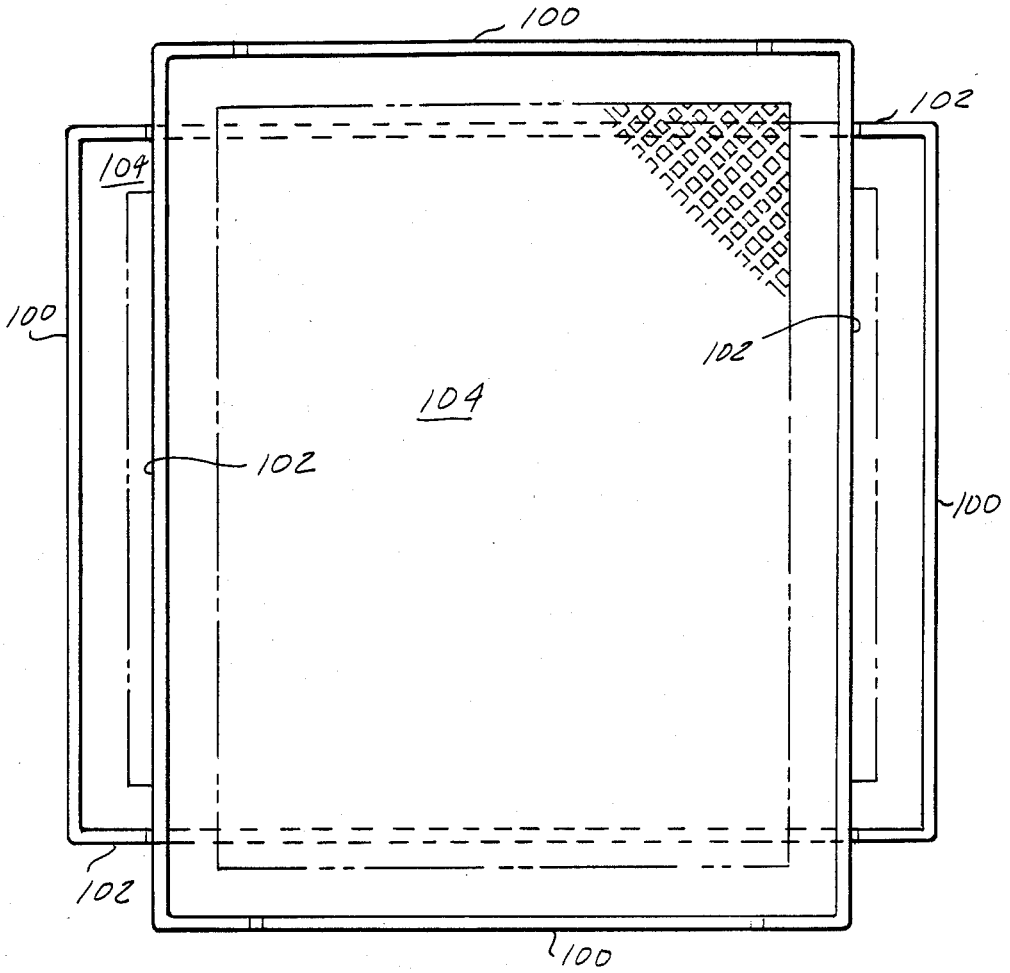
FIG-14 PRIOR ART
Figure 15:
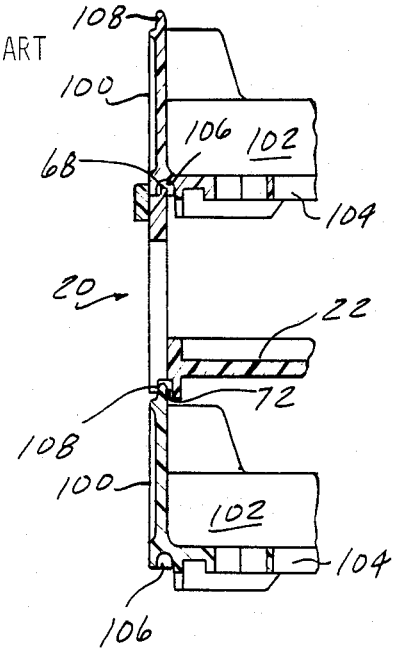

FIG. 12 is a side elevational view of two prior art containers generally similar to those disclosed in U.S. Pat. No. 4,093,070, stacked in a high-level stacking position;

FIG. 13 is a side elevational view of the two prior art containers shown in FIG. 12 stacked in a low-level stacked relationship wherein the upper container is stacked in crosswise relationship to the lower container;

FIG. 14 is a top plan view of the two containers in the stacked relationship of FIG. 13; and FIG. 15 is a side elevational view, with certain parts broken away, showing a container embodying the present invention stacked at a high-level stacking relationship between two prior art containers of the form shown in FIGS. 12 through 14.

Figure 1:
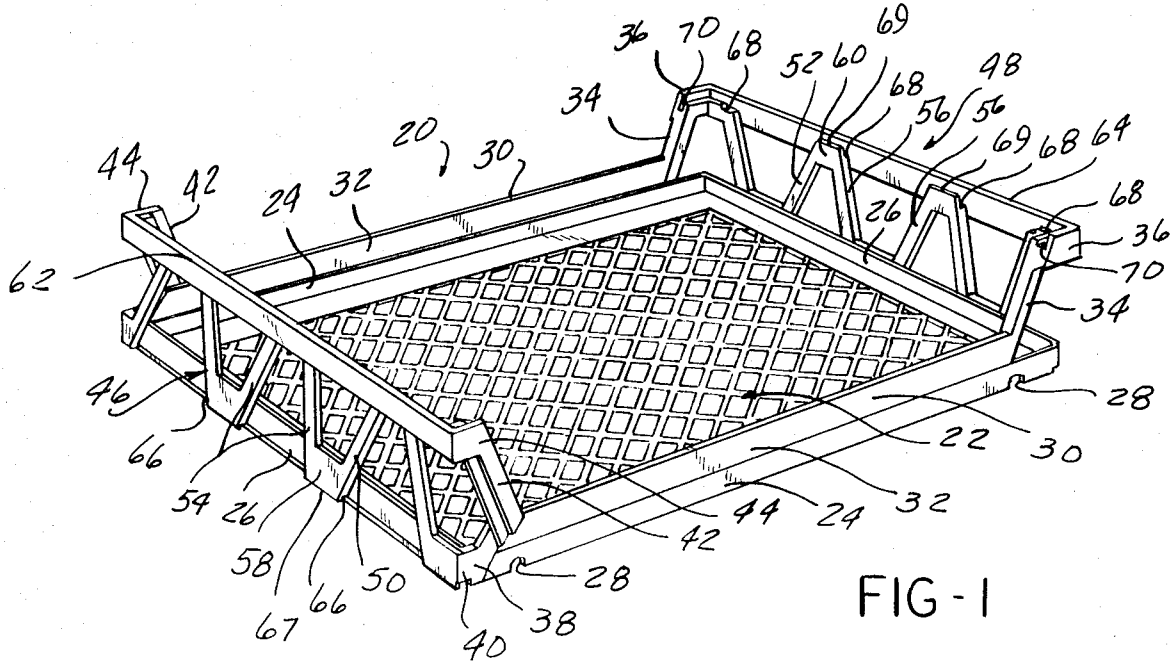
FIG. 1 is a perspective view of a container embodying the present invention.
Figure 2:
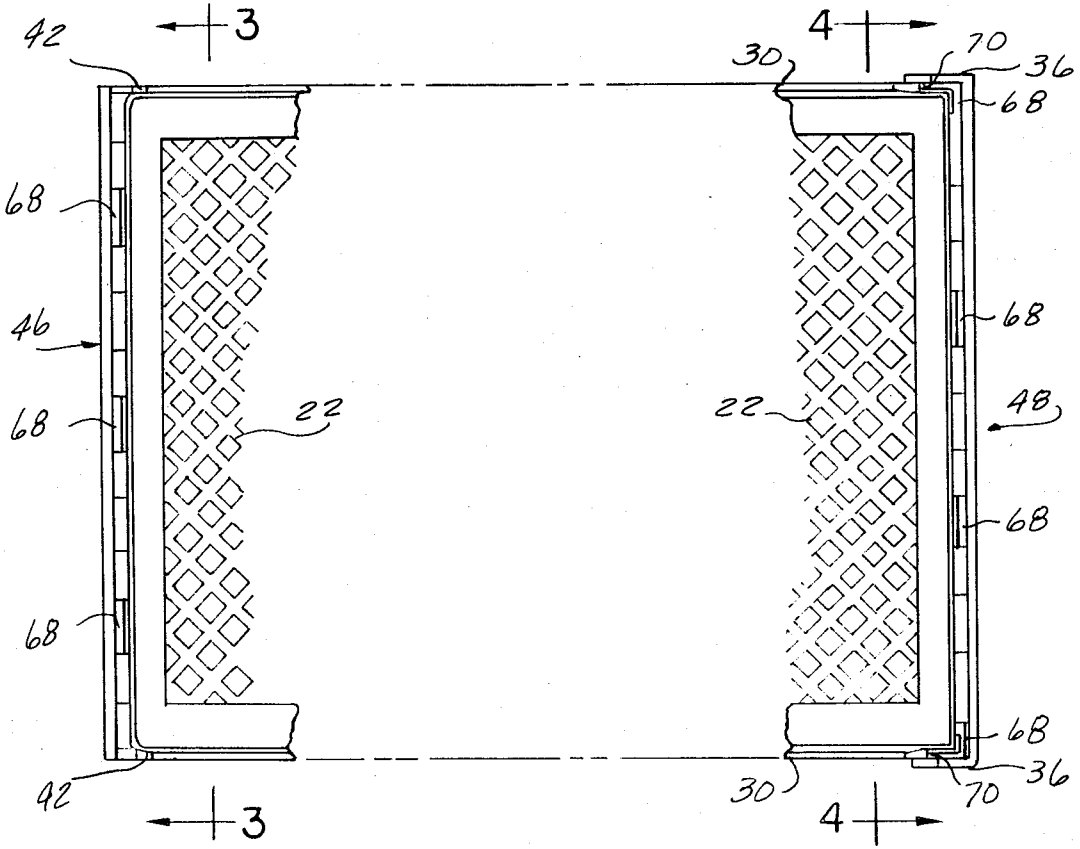
FIG. 2 is a top plan view, with certain parts broken away, with the container of FIG. 1.
Figure 3:
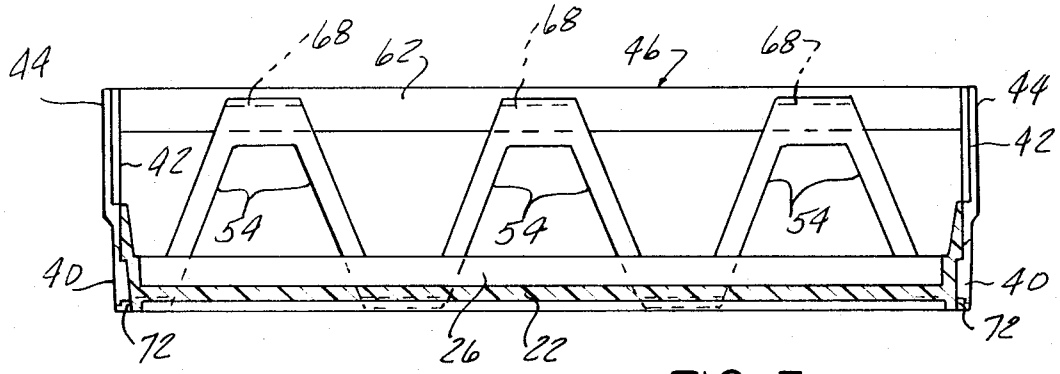
FIG. 3 is a cross-sectional view of the container taken on the line 3—3 of FIG. 2.
Figure 4:
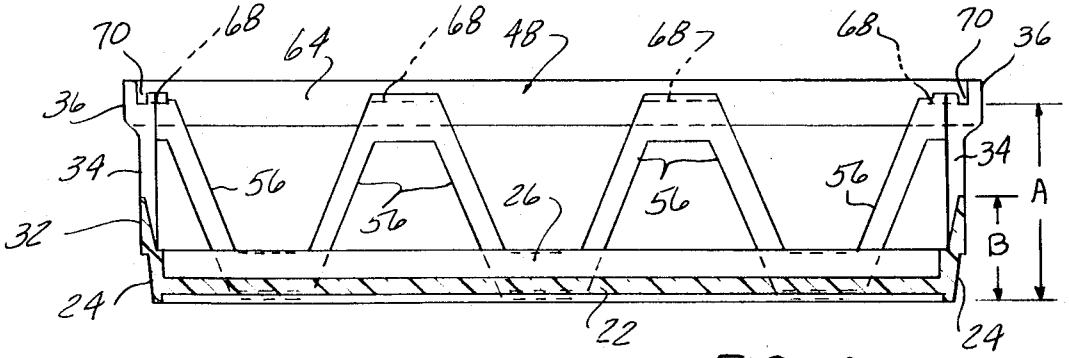
FIG. 4 is a cross-sectional view of the container taken on the line 4—4 of FIG. 2.

A container designated generally 20 embodying the present invention is shown in perspective view in FIG. 1. Container 20 includes a rectangular bottom 22 having lower side 24 and end 26 rails which extend around its entire periphery and lie in vertical general planes. Bottom 22 is of rectangular configuration and is somewhat longer end to end than it is side to side. Stacking notches 28 are formed in the lower edges of lower side rails 24 and are spaced from each other by a distance equal to that between the opposed side walls 30 of the container so that, if desired, two like containers can be stacked one upon the other in crosswise relationship with the side walls 30 of the lower container projecting upwardly into the notches 28 in the bottom of the lower side rails of the upper container.

The two side walls 30 of container 20 are of mirror image construction and include a main or central web portion 32 which terminates short of the opposite ends of the respective side walls. At one end of each central web 32, an upwardly projecting bar member, lying in the same general vertical plane as the central web portion is inclined upwardly and outwardly from web portion 32 and is formed at its upper end with a relatively short upper side rail section 36 offset outwardly of the container from bar section 34.

At the opposite end of each central portion 32 of the side rail, a downwardly and outwardly inclined bar section 38 is formed integrally with central web 32 and lies in the same general vertical plane as does web 32, the bar section 38 having a relatively short horizontal seat section 40 at its lower end. The vertical general plane of the central web 32, upwardly inclined bar section 34, downwardly inclined bar section 38 and seat section 40 lies at the outer side of the associated lower side rail 24. At the outer side of the left hand end of central portion 32 of each side rail, a second upwardly and outwardly inclined bar section 42 is formed having a short upper side rail section 44 at its upper end. Bar section 42 and upper rail section 44 lie in the same general vertical plane as does the upper rail section 36 at the opposite end of the side wall, this vertical general plane being at the outer side of the main web 32.

End walls 46 and 48 are of different configuration. Each of end walls 46 and 48 includes a central or main web 50 and 52 respectively of symmetrically oppositely inclined bar sections as at 54, 56 which have the configuration of a series of V's having a short horizontal section such as 58 at their bottoms and connected in series to each other by relatively short horizontal sections such as 60 at their upper ends. The main webs 50 and 52 of end walls 46 and 48 lie in respective general vertical planes at the outer side of their respective lower end rails 26. A web-like upper end rail 62, 64 is fixedly secured to the outer side surface of the upper ends of the inclined bar sections of the respective side rails, the upper end rails 62, 64 being respectively joined at their opposite ends to upper side rail sections 44 and 36. Upper end rails 62 and 64 are thus horizontally outwardly offset from their associated lower end rails 26 by the thickness of the main web portions 50, 52 of the respective end walls.

Figure 10:
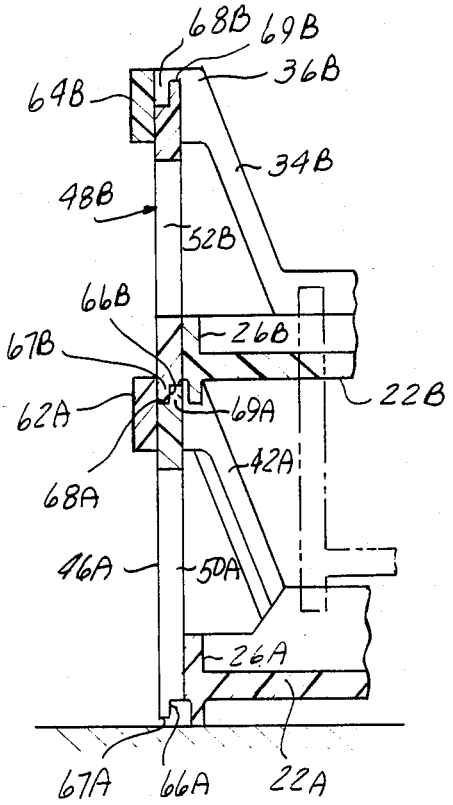
FIG. 10 is a cross-sectional view taken on the line 10—10 of FIG. 5.
Figure 11:
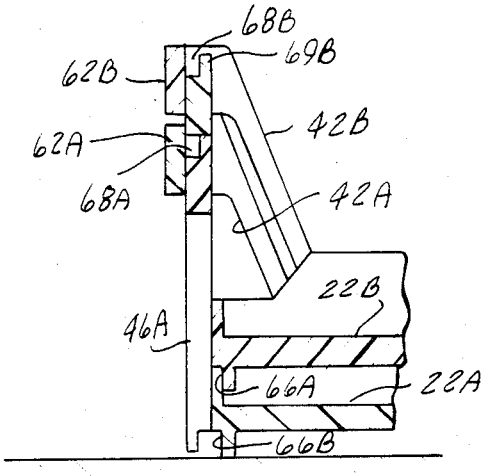
FIG. 11 is a cross-sectional view taken on the line 11—11 of FIG. 7.

It will be noted that the main web 50 of end wall 46 is formed with two intermediate upright V sections and one-half of an upright V section at each end, while end wall 48 has its main web 52 formed with three upright V sections. This out-of phase relationship is such that the lower horizontal sections 58 of main web 50 of end wall 46 are aligned longitudinally of container 20 with the upper horizontal sections 60 of the opposite end wall 48. Horizontal sections 58 of the respective end walls are provided with downwardly opening grooves 66 at their inner sides, while the upper horizontal sections of the main end wall webs are formed with upwardly opening grooves 68 at their outer side. The ungrooved portions of the upper end connecting section 60 of the side rail web form, with grooves 68, a tongue, while the ungrooved portions of the lower connecting sections 58 form tongues 67, the respective tongues and grooves being conformed, as best seen in FIG. 10, to seat one within the other when two like containers are stacked one upon the other with the second end wall of the upper container seated upon the first end wall of the underlying container.

To stabilize containers so stacked, similar grooves 70 are formed at the inner side of the upper rail sections 36 at each end of the second end wall, and complimentary grooves are formed at the inner side of the main web of each side wall to interfit with the upwardly opening right angled seats formed by grooves 68 and 70 when containers are stacked in first to second end wall relationship.

Figure 7:
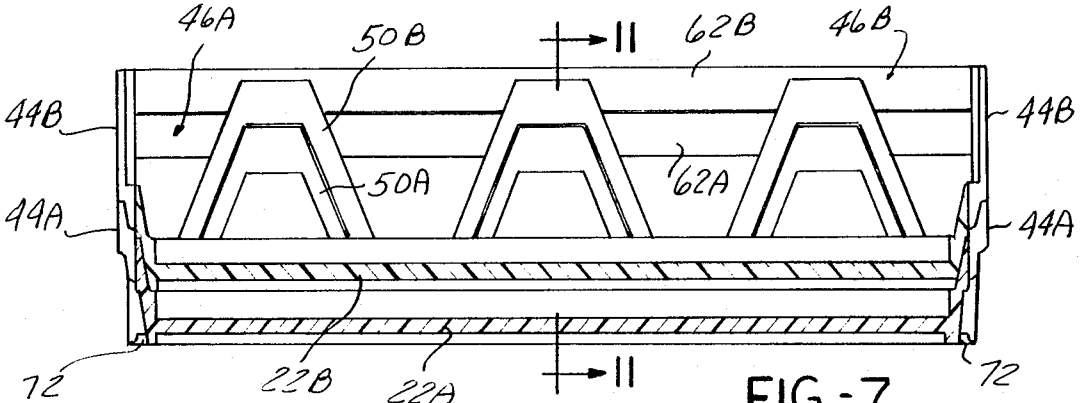
FIG. 7 is a cross-sectional view taken approximately at the location of the line 3—3 of FIG. 2 showing two containers stacked or nested in a low-level stacked relationship.
Figure 8:
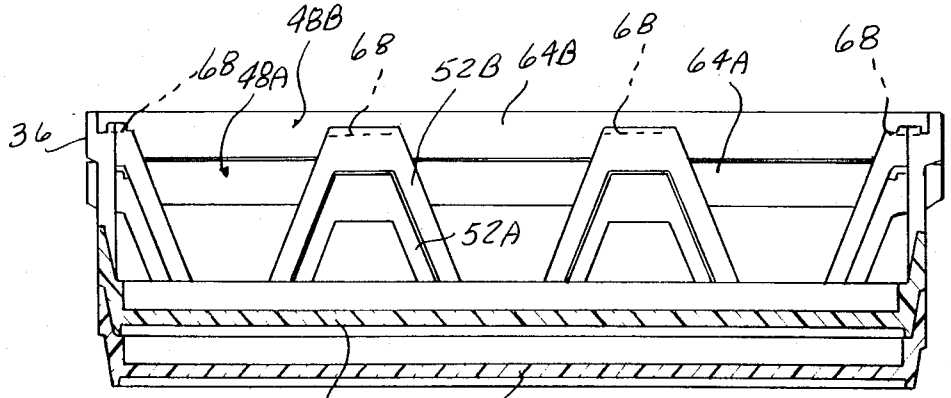
FIG. 8 is a cross-sectional view taken approximately at the location of the line 4—4 of FIG. 2 showing two of the containers stacked in a low-level stacked relationship.

When like containers are stacked in a like end wall to like end wall relationship—that is, first end wall to first end wall, second end wall to second end wall, the main webs of the end walls nest within one another, as best seen in FIGS. 7 and 8, as do the side walls, see FIG. 9. Essentially, the first and second end walls have complimentary upwardly and downwardly opening recesses formed between the respective inclined sections 54, 56 so that like end walls can nest within each other, while the lower connecting sections 58 of one end wall rest upon the upper connecting sections 60 of the other end wall to establish a high-level stacked position.

The length of end walls 46, 48 is less than the overall length of side walls 32. The length of the central section 32 of each side wall is equal to or slightly greater than the length of the end walls so that, if desired, two containers can be stacked upon each other with the upper of the two containers resting upon the upper edges of central sections 30 of the side walls, the side wall edges being received within the stacking notches 28 in the lower side rails. This crosswise stacking relationship is normally not employed when all containers in a stack are of the type to which the present invention is directed. This is because the containers of the present invention can be more deeply nested one within another when they are stacked in the lengthwise like end wall to like end wall relationship shown in FIGS. 7 through 9.

However, a stable stack of containers of the present invention consisting of three or more such containers each in crosswise relationship to the underlying container can be formed. In such a stack of three containers, the uppermost container may be stacked in the high-level stacked relationship relative to the lowermost container with the intermediate container of the stack sandwiched between them. For practical purposes, the height of central section 32 of the side walls is approximately one-half the height of the end walls.

As stated above, the container of the present invention is especially adapted so that it can be intermingled with certain other containers of the general type shown in U.S. Pat. No. 4,093,070. In FIGS. 12 through 14 of the present application, prior art containers of the general type shown in U.S. Pat. No. 4,093,070 are shown in high-level and low-level stacked relationship with each other. The prior art containers shown in FIGS. 12 through 14 are shown in a high stacked relationship in FIG. 12 and in a low stacked or nested relationship in FIGS. 13 and 14. The prior art containers of FIGS. 12 through 14 are constructed with like end walls 100 and like side walls 102 which project upwardly from the respective ends and sides of a generally rectangular bottom 104. A downwardly opening recess 106 is formed along the lower edge of each side wall 100 and an upwardly projecting tab 108 extends along the upper side of each end wall 100 so that when containers are stacked one upon the other as in FIG. 12 with the end walls of one supported on the end walls of the underlying container, the rails 108 of the lower container are received within the notches 106 of the upper container. With this particular type of container, as stated above, the end walls are identical and thus there is no necessity of matching the end walls of the two containers when stacking in the high stacked relationship of FIG. 12.

The side walls 102 of the containers of FIGS. 12 through 14 have a lowered main central section 110 which is of a length, as best seen in FIG. 13, equal to or slightly greater than that of the end walls 100. A single stacking notch 112 is formed in the lower edge of each side wall 102, and its length is likewise equal to the width of the container. When the containers of FIGS. 12 through 14 are empty, they may be stacked in a low-level stacked relationship by stacking alternate containers crosswise relative to each other. The height of central section 110 of the container is approximately one-half of the height of the end wall.

Like the containers of the present invention, the prior art containers shown in FIGS. 12 through 14 are constructed in more or less standard sizes. Typically, these containers are sold in large volume to large commercial bakeries who will specify, for example, that the containers must be dimensioned to hold a dozen loaves of bread of a given length, width and height. The dimensions of the contents thus determine the overall dimensions of the containers. In most cases where these overall dimensions are the same, containers embodying the present invention may be intermingled in stackes in either high or low-level stacking relationship with prior art containers of the type shown in FIGS. 12 through 14.

Referring to FIG. 15, there is shown a cross-sectional view of three containers stacked in high-level relationship to each other in which the uppermost and lowermost containers are prior art containers of the type shown in FIGS. 12 through 14 and the middle container is a container of the present invention. The rail 108 of the lowermost container of the stack of FIG. 15 is received within the notches 66 at the inner side of the main web of the end wall of the container 20 of the present invention and the rail 106 of the uppermost container is received within the notch 68 at the upper edge of the end wall, with the tab 69 at the inner side of notch 68 on container 20 projecting upwardly along the inner side of rail 106. The rails 106 and 108 of the prior art containers are substantially continuous and thus bridge all of the spaced upper and lower connecting portions of the main end wall webs of container 20, hence the end wall orientation of containers 20 is immaterial when it is stacked upon a prior art container of the type of FIGS. 12 through 14.

To intermingle the prior art containers of the type shown in FIGS. 12 through 14 with those of the present invention in a low-level stacked relationship, the unlike containers are stacked in crosswise relationship with each other. Where a container of the type shown in FIGS. 12 through 14 is stacked upon a first container 20 of the type of the present invention, a subsequent container of the type shown in FIGS. 12 through 14 may be added to the top of the stack in crosswise relationship to its like underlying container as in FIGS. 13 and 14.

Where a container 20 of the present invention is to be stacked upon a container of the type of FIGS. 12 through 14 which is in turn supported in crosswise relationship upon an underlying container 20, the uppermost container 20 can be either supported in a high stacked relationship with the underlying container 20 and clear the central sections of the intermediate prior art container as indicated in broken line in FIG. 10. This situation will occur when the uppermost container 20 is added to the stack in reversed end wall relationship to the underlying container. If the upper container 20 is placed in the stack in a like end wall to end wall relationship with the underlying container 20, the uppermost container 20 will receive the central sections 110 of the container of FIGS. 12 through 14 within stacking notches 28. Normally the difference in elevation of the three containers is very slight regardless of which end wall orientation between the two containers 20 is chosen.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. In a multi-level stacking container having a rectangular bottom, first and second end walls projecting upwardly from respective opposite ends of said bottom and side walls projecting upwardly from each of the opposite sides of said bottom, said end walls having complementary vertically upwardly and downwardly extending recesses whereby two like containers may be alternatively stacked in a high-level stacked relationship by resting the first and second end walls of the upper container upon the respective second and first end walls of the lower container or in a low-level stacked relationship wherein the first and second end walls and side walls of the upper container are nested within the respective first and second end walls and side walls of the lower container; the improvement wherein said end walls are of a first length and a first height, said side walls being of a second length greater than said first length and having a main central section of a length at least equal to said first length and a height approximately one-half of said first height, relatively short end sections on each side wall of a height equal to said first height joined to the adjacent end walls, stacking rails projecting downwardly from said bottom along the respective side edges thereof, and means defining a pair of upwardly opening notches in each of said stacking rails spaced from each other by a distance equal to the spacing between said side walls whereby two like containers may be stacked one upon the other in a crosswise relationship wherein the end walls of one of the containers are parallel to the side walls of the other and with the upper edges of the central sections of the side walls of the lower container projecting upwardly into the notches in the stacking rails of the upper container to stably support the upper container in an intermediate level stacked relationship upon the lower container.

2. The invention defined in claim 1 wherein the depth of said notches is related to the vertical dimensions of said end and side walls such that when two of said containers are stacked in the aforementioned crosswise relationship, a third like container may be stacked in crosswise relationship on the uppermost of said two containers and where so stacked said third container is supported substantially in a high-level stacked relationship to the lowermost container in the stack.

* * * * *